US005153895A

United States Patent [19]

Pena

[11] Patent Number: 5,153,895

[45] Date of Patent: Oct. 6, 1992

[54] NONCONSUMABLE, WATER-COOLED ELECTRODE FOR ELECTRIC METAL SMELTING DEVICE

[76] Inventor: Blas D. Peña, Norte America Num. 877, Colonia Vista Hermosa, 64620 Monterrey, N.L., Mexico

[21] Appl. No.: 679,797

[22] Filed: Apr. 3, 1991

[30] Foreign Application Priority Data

Aug. 21, 1990 [MX] Mexico ..... 22.036

[51] Int. Cl.[5] ..... H05B 7/08

[52] U.S. Cl. ..... 373/90; 373/88; 373/93; 373/101; 219/137.42; 219/137.62

[58] Field of Search ..... 373/88, 18, 90, 91, 373/92, 93, 101, 107; 219/121.36, 123, 383, 137.62, 137.42; 75/10 R

[56] References Cited

U.S. PATENT DOCUMENTS

| | | | |
|---|---|---|---|
| 3,368,019 | 2/1968 | Corso et al. | 373/93 |
| 3,781,449 | 12/1973 | Wolf et al. | 373/93 |
| 4,004,076 | 1/1977 | Paton et al. | 373/93 |
| 4,168,392 | 9/1979 | Prenn | 373/93 |
| 4,291,190 | 9/1981 | Elsner et al. | 373/93 |
| 4,304,980 | 12/1981 | Fridlyand et al. | 219/121 |
| 4,309,590 | 1/1982 | Stol | 219/137.62 |
| 4,466,105 | 8/1984 | Bauer et al. | 373/93 |
| 4,466,824 | 8/1984 | Gauvin et al. | 75/10 R |
| 4,481,636 | 11/1984 | Curr et al. | 373/18 |
| 4,488,312 | 12/1984 | Montgomery et al. | 373/93 |

*Primary Examiner*—Bruce A. Reynolds
*Assistant Examiner*—Tu Hoang
*Attorney, Agent, or Firm*—Ostrolenk, Faber, Gerb & Soffen

[57] ABSTRACT

A nonconsumable water-cooled electrode for electric metal smelting furnaces which includes inner and outer concentric steel tubes defining an annular space therebetween through which cooling water may be passed. A tungsten tip is attached to the tubes at their lower ends. Electric current is introduced through a plurality of copper bars attached to the tungsten tip at one end and to a copper plate at the upper end. The copper plate is adapted to attach the electrode to a suitable electrode carrier. A central pipe is provided through which an inert gas, such as argon, may be passed through the electrode.

5 Claims, 2 Drawing Sheets

FIG. 1
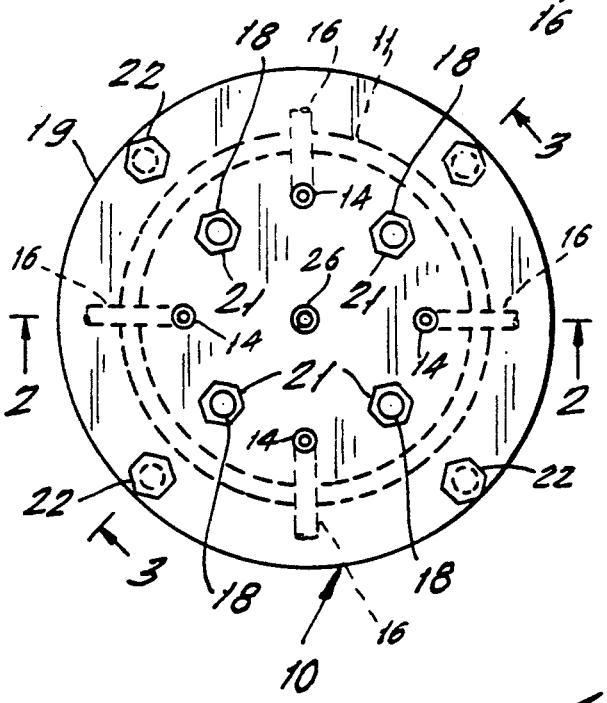
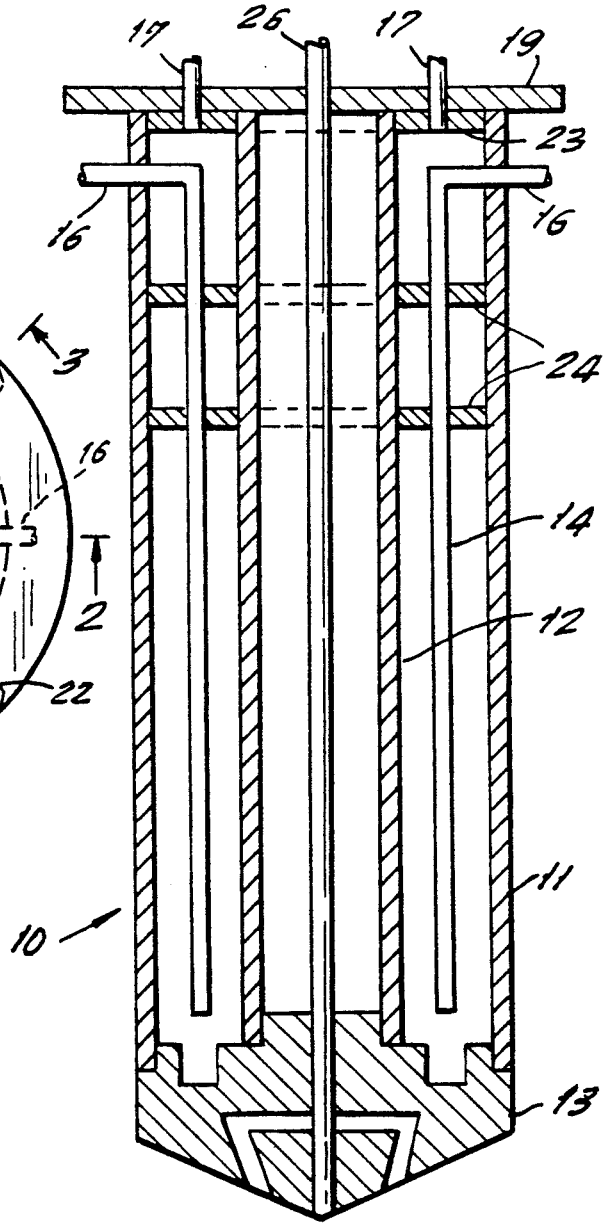
FIG. 2

NONCONSUMABLE, WATER-COOLED ELECTRODE FOR ELECTRIC METAL SMELTING DEVICE

BACKGROUND OF THE INVENTION

The present invention relates to electrodes for electric metal smelting furnaces and, more particularly, to such electrodes which are non-consumable and water-cooled.

As is known, electric arc furnaces use carbon or graphite electrodes. However, the graphite electrodes typically used in electric furnaces for smelting metals are very expensive and are also consumable, brittle and represent a high expenditure in the operation of the furnaces. In addition, a certain quantity of these graphite electrodes must be kept in the warehouse, where they represent a necessary but nonproductive investment, all of which is disadvantageous.

SUMMARY OF THE INVENTION

One object of this invention is to provide new and improved electrodes for electric furnaces for smelting metals which are nonconsumable and water-cooled.

Another object of this invention is the use of inert gas for operation, thereby avoiding the production of smoke.

Another object of this invention is the use of water as a system for cooling electrodes for metal smelting furnaces.

The foregoing and other objects are achieved in accordance with certain principles of the present invention by a nonconsumable, water-cooled electrode for metal smelting furnaces which includes inner and outer concentric metal tubes having respective upper and lower ends. An annular space is defined between the tubes. A metal tip is attached to the tubes at their respective lower ends. A plurality of pipes are provided for introducing water into the annular space between the tubes, and a plurality of exit conduits are provided for allowing exit of the water from the annular space. A plurality of conductive bars having upper and lower threaded ends are provided for facilitating passage of electric current through the electrode. A plate is connected to the respective upper ends of the metal pipes, the plate also being connectable to the head of a carrier for the electrode. A central pipe is provided for the passage of an inert gas.

Other features and advantages of the present invention will become apparent from the following description of the invention which refers to the accompanying drawings.

BRIEF DESCRIPTION OF THE DRAWINGS

FIG. 1 is a top plan view of an electrode illustrating certain principles of the present invention;

FIG. 2 is a cross-sectional view taken along the lines 2—2 of FIG. 1;

DETAILED DESCRIPTION OF THE PREFERRED EMBODIMENT

Figure 3:
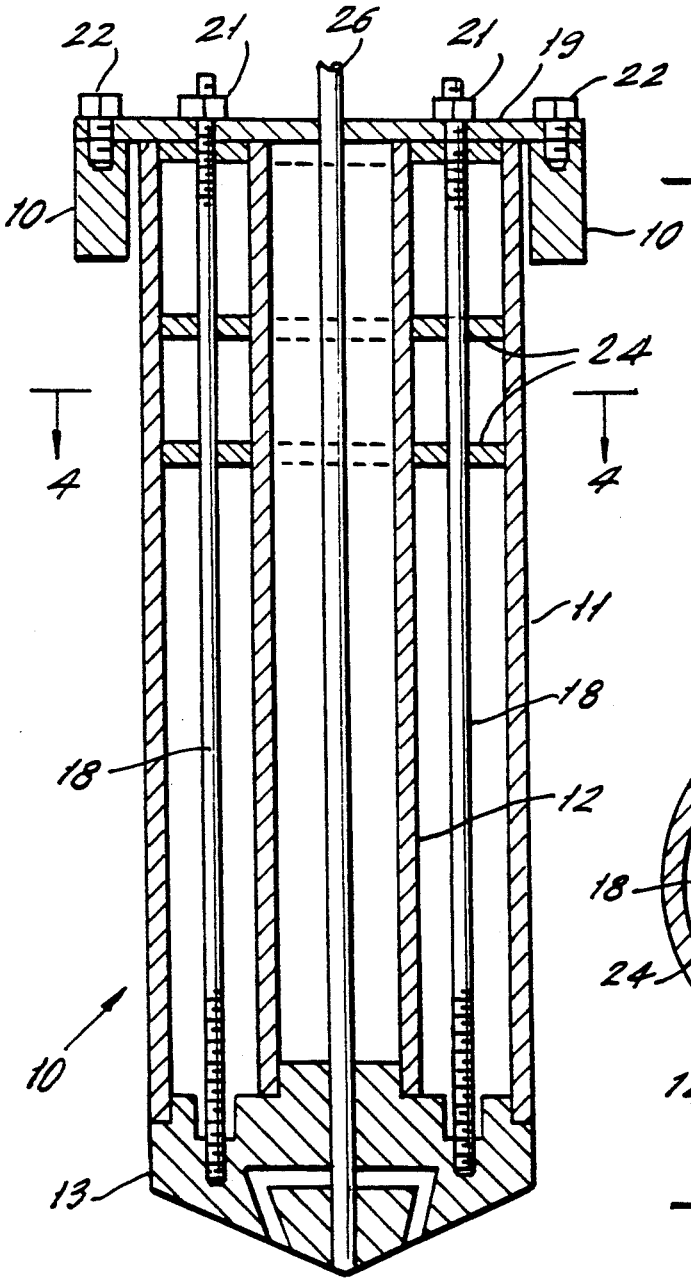
FIG. 3 is a cross-sectional view taken along the lines 3—3 of FIG. 1.

Referring to the drawings and, particularly, to FIG. 2, the new nonconsumable, water-cooled electrode 10 of this invention comprises basically a construction of two concentric steel pipes or tubes, an outer stainless steel tube 11 and an inner carbon steel tube 12. The lower part of the electrode includes a tungsten metal tip 13.

The cooling system is comprised of cooling pipes 14—14 that carry water which enters via inlets 16—16 to the lower part of the electrode 10, the water then exiting the electrode via conduits 17—17.

Referring now to FIGS. 1 and 3, the electrode 10 also has four round copper bars 18—18, threaded on the ends, which facilitate the passage of the great quantity of electric current that passes through the electrode 10. These copper bars 18—18 are screwed below to the tungsten tip 13 and above they are coupled to a circular copper plate 19 with screws 21-1. The plate 19 has a diameter sufficiently large so as to enable the electrode 10 to be supported on copper members 10 in the head of an electrode carrier (not shown). The plate 19 is attached to the members 10 by means of screws 22—22.

Figure 4:
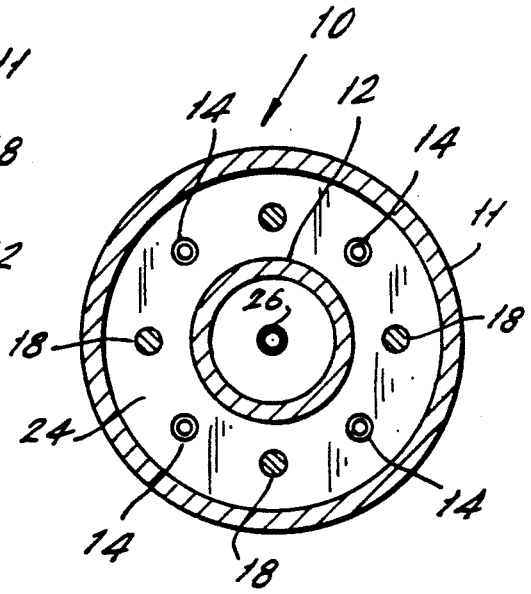
FIG. 4 is a cross-sectional view taken along the lines 4—4 of FIG. 3.

As best seen in FIGS. 2, 3 and 4, the electrode 10 also comprises carbon steel reinforcement annular members, an upper member 23 through which the water exit conduits 17—17 pass and two lower pieces 24—24 through which the cooling pipes 14—14 and the copper bars 18—18 pass.

In the central part of the electrode 10, there is a pipe 26 that allows the passage of the necessary inert gas for operation of the electrode.

In the above manner, a nonconsumable, water-cooled electrode is obtained that is highly economical since its service life is very long if it is given adequate maintenance and cooled with treated water. The cost for its services will be only its construction and the expense of the inert gas required for operation. The inert gas that is used, which may be argon or any other inert gas, can be recirculated in the furnace, making its cost insignificant.

In a preferred embodiment, four cooling pipes 14—14, four copper bars 18—18 and three reinforcement pieces 23 and 24—24 are used.

As can be seen in the drawings, the nonconsumable electrode is a welded structure.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A nonconsumable, water-cooled electrode for melting smelting furnaces, comprising:

inner and outer centric metal tubes having respective upper and lower ends, the tubes defining an annular space therebetween;

a metal tip attached to the tubes at their respective lower ends;

a plurality of pipes for introducing cooling water into the annular space and a plurality of conduits for allowing exit of the water from the annular space;

a plurality of conductive copper bars having upper and lower threaded ends, the lower threaded ends being attached to the metal tip for establishing conductive paths therebetween;

a copper plate connected to the respective upper ends of the inner and outer tubes and the conductive bars, the plate being connectable to a carrier for the electrode for establishing a conductive path from the carrier to the metal tip via the copper plate and the conductive copper bars; and a central pipe for the passage of an inert gas.

2. An electrode according to claim 1, further comprising an upper reinforcement member between the inner and outer tubes through which the exit conduits pass and second and third reinforcement members between the inner and outer tubes through which the cooling pipes and conductive bars pass.

3. An electrode according to claim 1, wherein the inner and outer tubes are made of steel.

4. An electrode according to claim 3, wherein there are four cooling pipes and four copper bars.

5. An electrode according to claim 4, wherein the metal tip is made of tungsten.

* * * * *